United States Patent [19]

Dwelley et al.

[11] Patent Number: 4,730,734

[45] Date of Patent: Mar. 15, 1988

[54] SECURITY DEVICE

[76] Inventors: Ronald C. Dwelley, 1517 Sunset La., Fullerton, Calif. 92633; Dale Matsuda, 9342 Woodcrest Dr., Fullerton, Calif. 92633; Robert B. Tanaka, 2766 Loreto Ave., Costa Mesa, Calif. 92626

[21] Appl. No.: 805,277

[22] Filed: Dec. 5, 1985

[51] Int. Cl.[4] ..... E05B 73/00

[52] U.S. Cl. ..... 211/8; 211/49.1; 211/59.4; 211/207; 211/209; 269/237

[58] Field of Search ..... 211/8, 9, 207, 209, 211/168, 49.1, 50, 59.4, 70.1; 269/91, 237

[56] References Cited

U.S. PATENT DOCUMENTS

| | | | |
|---|---|---|---|
| 198,049 | 12/1877 | Schater | 211/209 |
| 374,376 | 12/1887 | Slooter | 211/209 |
| 573,258 | 12/1896 | Brand | 211/8 |
| 774,379 | 11/1904 | Cavanaugh | 211/209 |
| 781,356 | 1/1905 | Peelman | 269/91 |
| 993,166 | 5/1911 | Heriot | 211/8 |
| 1,051,930 | 2/1913 | Vaughn | 211/9 |
| 2,288,822 | 7/1942 | McCarron | 211/1.5 |
| 3,610,431 | 10/1971 | Rodden | 211/207 |
| 4,107,958 | 8/1978 | Manley, Jr. | 211/8 |
| 4,312,452 | 1/1982 | Waier | 211/8 |

FOREIGN PATENT DOCUMENTS

| | | | |
|---|---|---|---|
| 81964 | 1/1957 | Denmark | 269/237 |

*Primary Examiner*—William F. Pate, III
*Assistant Examiner*—Michael Safavi
*Attorney, Agent, or Firm*—Price, Gess & Ubell

[57] ABSTRACT

A security device for storing and retaining of products or product packing devices such as pallets, crates and the like having a clamping mechanism slidably mounted on and drivable with respect to a vertical column, the clamping mechanism including one or more pivotally mounted arms carrying one or more clamping pads adapted to clamp a stack of products or product packing devices between a pad and base member of the device.

9 Claims, 12 Drawing Figures

11
55
11
53
53
45
43
43
39
41
37
35
45

83
55
11
43
51
45
41
39
37
35
47
40
31
29
32
49
17
13
42
18
15
62
73
33
23
97
31
32
21
11
78
67
27
19
32
16
97
53
97
11
25
59
15
65
63
61
67
69

SECURITY DEVICE

BACKGROUND OF THE DISCLOSURE

The subject invention relates generally to security devices and more particularly to a security device for securing products or product packing devices such as pallets and crates used, for example, in retail distribution.

According to prior procedures, reusable packing devices such as pallets, crates, trays, boxes etc., have been used in the shipping of goods. Such devices are often left unattended in open areas where they are exposed to theft or damage. Building materials such as lumber are often similarly left exposed in construction areas and are favorite targets of theft and vandalism.

SUMMARY OF THE INVENTION

It is therefore an object of the invention to provide a security device for products and product packing devices.

It is another object of the invention to provide a security device for such packing devices and products which is conveniently locatable near the working area where such products and devices are frequently stored or used.

It is yet another object of the invention to provide such a security device which is safe and easy to operate.

Accordingly, the invention provides a secured, free standing clamping apparatus particularly designed to retain pallets and other types of packing devices or products. The apparatus employs a clamping pad moveably mounted on a vertical member. The pad is adjustable to accomodate stacks of various heights of products or packing devices and is lockable in a clamping mode to secure the products or packing devices in position. According to a feature of the invention, the pad may be interchangeable in order to adapt the apparatus of the invention to various types of products or packing devices. The invention further has the advantage of enabling the secure use of previously unused space outside of a retail establishment or warehouse.

BRIEF DESCRIPTION OF THE DRAWINGS

The preferred embodiment of the invention will now be disclosed in conjunction with the drawings of which.

DETAILED DESCRIPTION OF THE PREFERRED EMBODIMENT

Figure 6:
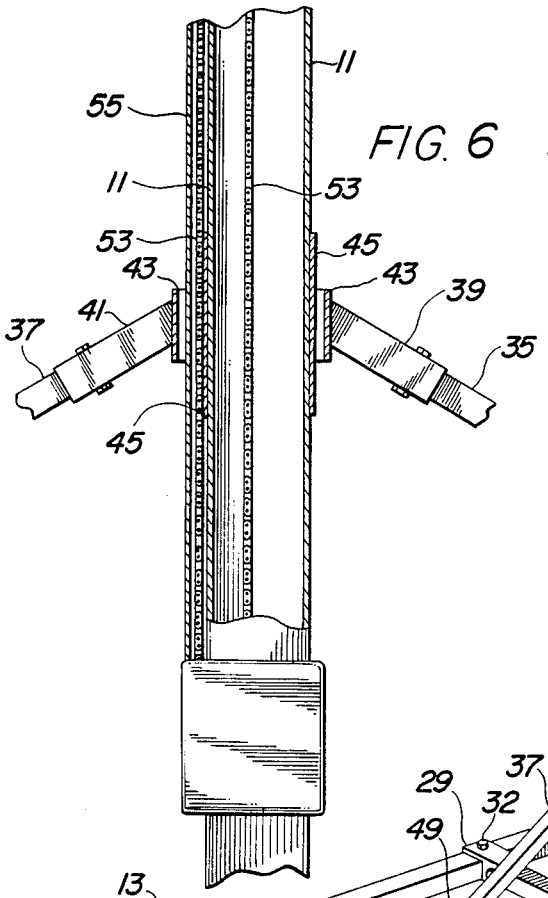
FIG. 6 is a sectional view of the top of the vertical column of the preferred embodiment.
Figure 1:
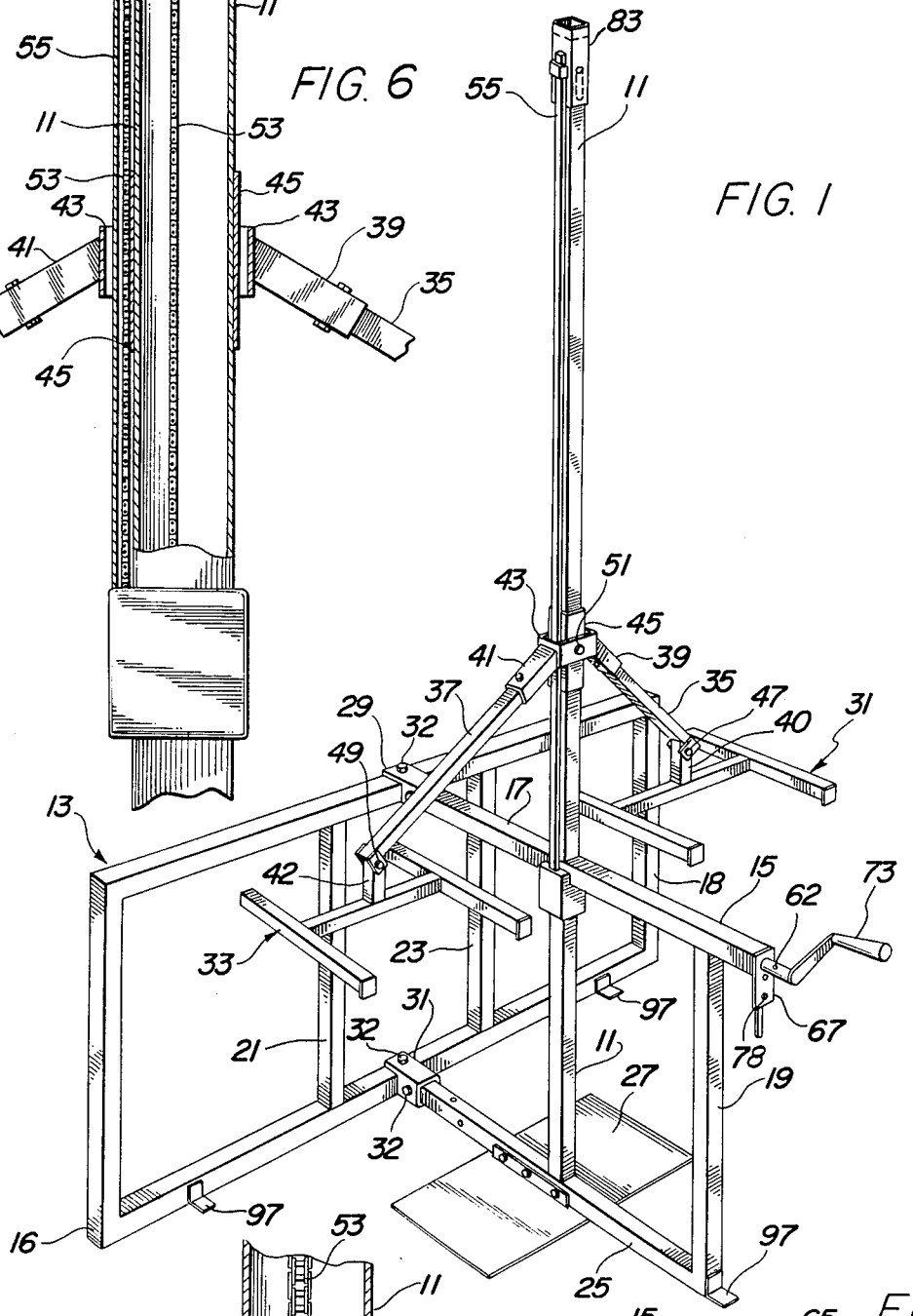
FIG. 1 is a perspective of the preferred embodiment of the invention.

As illustrated in FIG. 1, the preferred embodiment includes a vertical frame member 11 attached to a center base member 25 and braced by front and rear crank rails 15, 17. The front crank rail 15 rigidly attaches to a front upright member 19, which is rigidly attached to a center base 25. The center base 25 and rear crank rail 17 are each attached to a rear frame 13. The rear frame 13 includes two frame sections 16, 18 each welded to a respective side of upper and lower tubular adjustment brackets 29, 31. Alternatively, the horizontal rear frame members may be of single piece construction with adjustment brackets welded or otherwise attached on the under surface thereof. Each rear frame section 16, 18 is braced by respective rear uprights 21, 23. The frame structure is generally of square metal tubular construction.

The rear crank rail 17 and center base member 25 are attached to the rear frame 13 by the upper and lower adjustment brackets 29, 31. These brackets 29, 31 and the accompanying pins 32 permit the center base member 25 and rear crank rail 17 to be selectively positioned. With the pins 32 removed, the position of the rear crank rail 17 and center base 25 may be slidably adjusted in a direction perpendicular to the plane of the rear frame 13. Such adjustment enables the preferred embodiment to better accomodate various sizes of pallets or other containers.

In FIG. 1, a sleeve 45 is slidably mounted on the vertical column 11. An arm swivel 43 is pivotally mounted by a pin 51 to the sleeve 45. First and second receivers 39 41 are welded to the swivel arm 43 at an angle, for example, of thirty degrees in the embodiment shown. First and second square tubular arms 35, 37 are inserted into the respective receivers 39, 41 and bolted into position. First and second pads 31, 33 are pivotally mounted by pivots 49, 47 at the end of each arm 35, 37, opposite the receivers 39, 41. These pads 31, 33 present a tubular generally "H" shaped construction, depending from perpendicular supports 40, 42. The arms 35, 37 and pads 31, 33 are removable, providing interchangeability with other arms and pads designed to accomodate other packing devices. The sleeve 45, swivel 43, arms 35, 37 and pads 31, 33 comprise a clamping mechanism slidably mounted on the vertical column 11.

A base plate 27 is further bolted to the center base 25. The base plate 27 facilitates assertion of upward as well as downward clamping forces and precludes any tendency of the preferred embodiment to rise off the ground in response to the assertion of downward force by the clamping pads 31, 33. The preferred embodiment is preferably fastened to the ground by suitable L brackets 97 attached to the front upright 19 and rear frame 13.

In operation, the pivot points provided by pivots 47, 49, 51 provide an improved clamping function. In particular the flexibility of movement provided enables accomodation of loads of varying heighth or surface irregularity.

Figure 5:
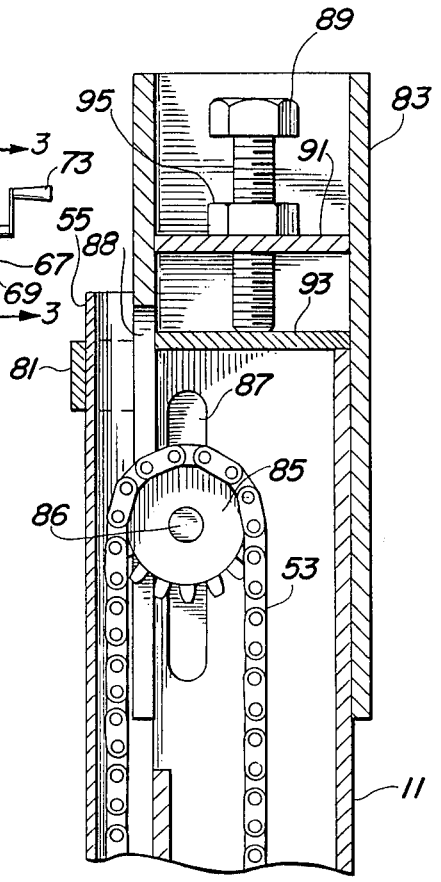
FIG. 5 is a sectional view taken at 5—5 of FIG. 2.

The sleeve 45 and accompanying clamping pads 31, 33 are driven up and down the vertical column 11 by a chain and crank mechanism. To facilitate this operation, the sleeve 45 is attached to a chain 53, which rides on sprockets, e.g. 85, within the vertical column 11 (FIG. 5). The chain exits the vertical column 11 via a slot 88 therein. A chain guard 55 is attached between a bracket 81 and a gear box 59 and seals off access to the chain 53. In an alternate embodiment, a cable may be used in place of the chain 53.

Driving power is supplied to the gear box 59 by a crank rod 61 (FIG. 4) rotatably mounted on the front crank rail 15. The crank rod 61 is driven by a removable crank handle 73 mounted by means of a pin 62 inserted in a suitable pin hole 63.

Figure 4:
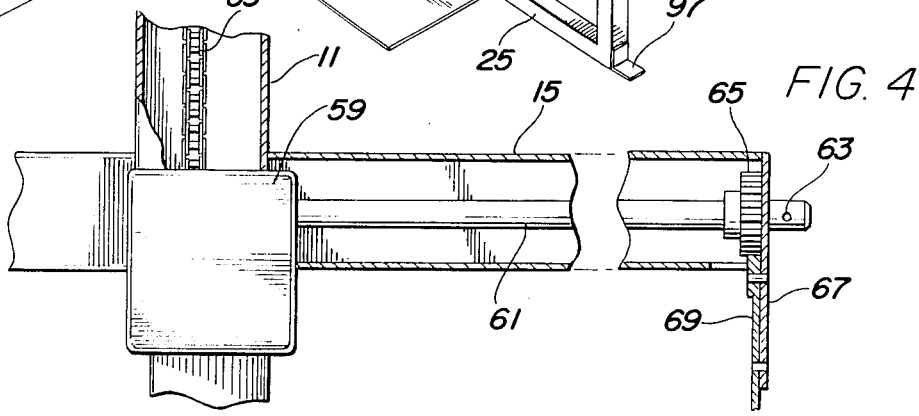
FIG. 4 is a sectional view illustrating the crank rail of the preferred embodiment of the invention.
Figure 3:
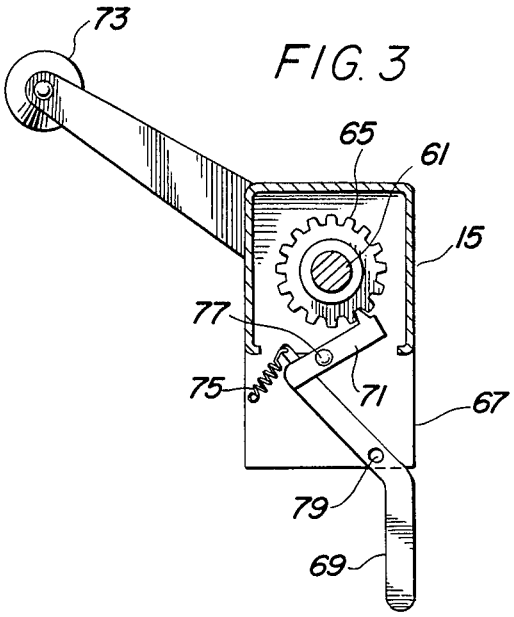
FIG. 3 is a sectional view taken at 3—3 of FIG. 2.

The preferred embodiment further incorporates a locking mechanism illustrated in detail in FIGS. 3 and 4.

As shown, a locking gear 65 is fixedly mounted to the crank rod 61. The locking gear 65 forms part of the ratchet locking mechanism together with a locking lever comprising elements 69, 71 and a spring 75. The locking lever elements 69, 71 are rigidly attached to one another and pivotally mounted by a pivot 77. The spring 75 maintains the locking lever 69, 71 engaged with the locking gear 65. This engagement precludes accidental slipping of the clamping mechanism on column 11, thereby providing a safety feature. In addition, the locking lever element 69 is provided with a circular aperture 79. A complimentary aperture 78 (FIG. 1) is formed in the crank plate 67. The complimentary apertures 79, 78 facilitate the insertion of a padlock or other locking mechanism to lock the clamping mechanism in position. A concentric shaft cover may also be welded to the crank plate 67 to surround and protect the exposed end of the crank rod 61 which carries pin 62. Such a shaft cover should be of sufficient diameter to enable insertion of crank handle 73.

The gear box 59 is a typical reduction gear box including a second sprocket for the chain 53 and providing for the assertion of approximately 200–5,000 pounds of force (100–2,500 pounds/arm) by the clamping pads 31, 33.

FIG. 5 illustrates an adjustment mechanism provided at the top of the vertical column 11. A sleeve 83 is slidably mounted with respect to the vertical column 11. The sleeve 83 and vertical column 11 contain complimenting slots providing an aperture 87 through which the sprocket shaft 86 is inserted. The sprocket shaft 86 is bolted to the sleeve 83 such that it may be selectively positioned within the aperture 87. A plate 93 is fixed to the top of the vertical column 11 and a plate 91 parallel to the plate 93 is fixed in the adjustment sleeve 83. A tension adjuster bolt 89 is threadably inserted into a nut 95, which is welded or otherwise attached to the sleeve plate 91. A tension adjustment may thus be provided by turning of the bolt 89.

The preferred embodiment is particularly adapted to the storing of pallets 34. The frame structure provided squares off the pallet load and the pivotal mounting of the clamping pads 31, 33 accomodates variations in the size of respective stacks of pallets 34. With a vertical column heighth of ten feet, two pallet stacks of approximately 15 pallets may be safely retained in position. While the preferred embodiment employs a removable hand crank mechanism, it is additionally possible to use a gear motor mounted to the top of a vertical column 11 to provide a motorized drive.

Figure 2:
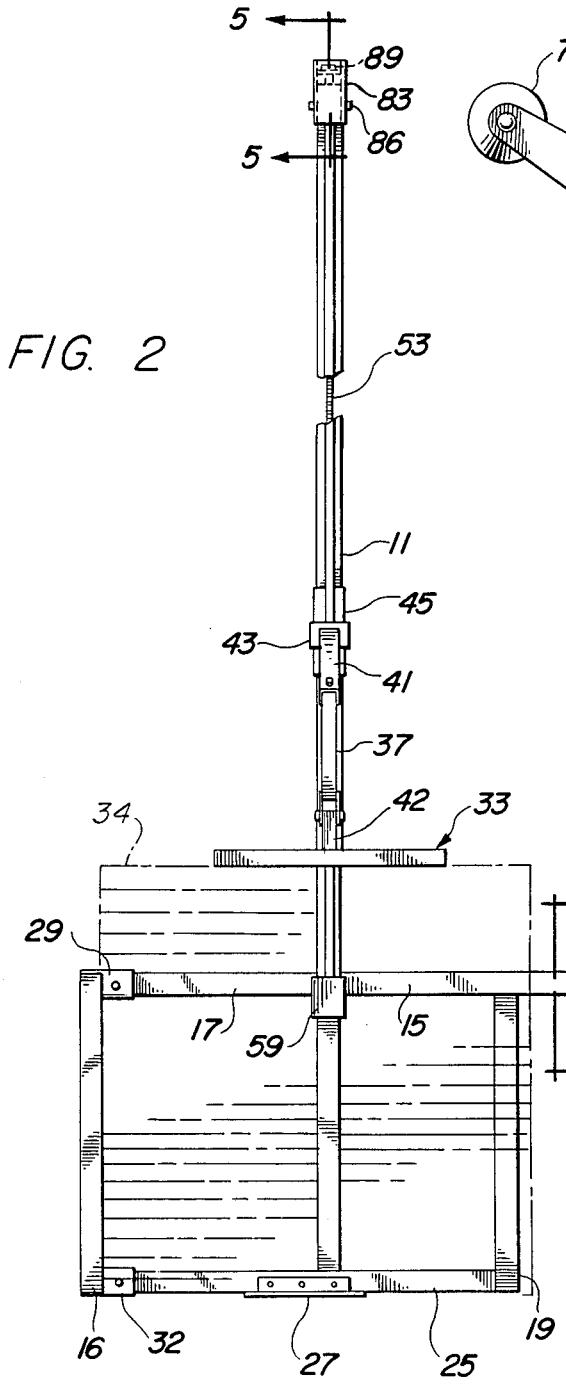
FIG. 2 is a side plan view of the preferred embodiment of the invention.
Figure 7:
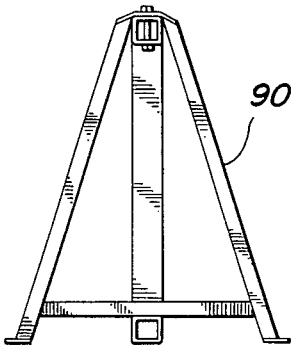
FIGS. 7 through 12 illustrate various alternative embodiments.
Figure 8:
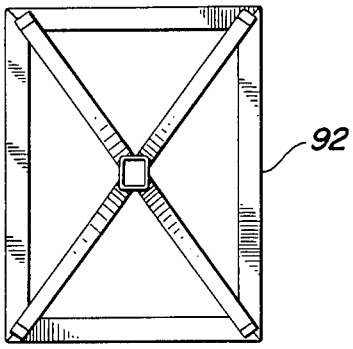
Figure 9:
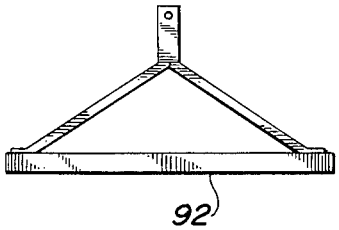
Figure 10:
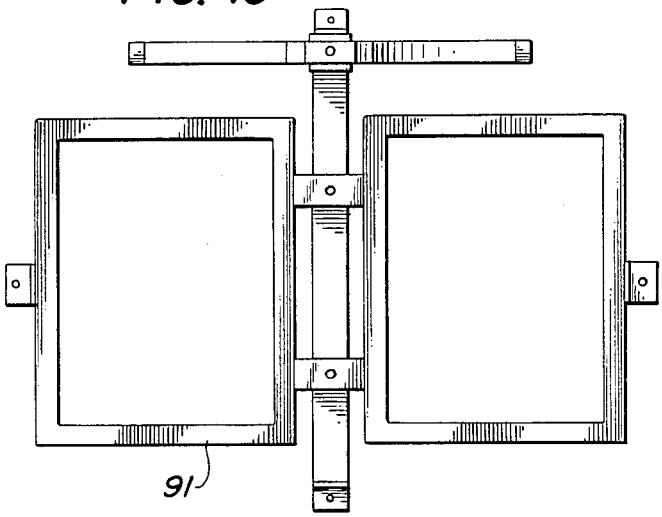
Figure 12:
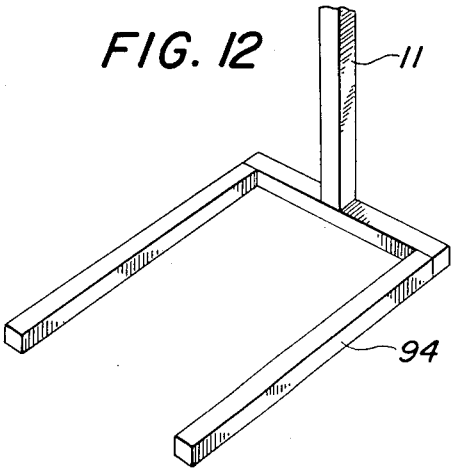
Figure 11:
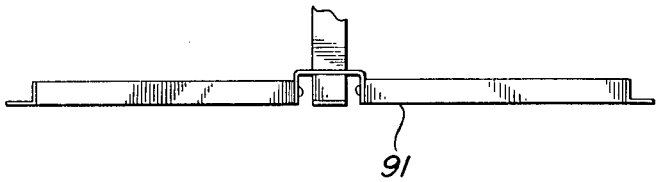

Variations in the design of the clamping structure used in the preferred embodiment are possible as illustrated in FIGS. 7 through 12. FIG. 7 illustrates a frame member 90 substitutable for frame member 13 and particularly adapted for storing milk crates. FIGS. 8 and 9 show top and side views of a clamping pad 92 forming a substantially rectangular cap of angle iron construction suitable for retaining milk crates. FIGS. 10 and 11 illustrate a base structure 91 usable with the frame 90 and pad 92 of FIGS. 7–9. FIG. 12 illustrates a U-shaped base member 94 usable, for example, in a pallet holding embodiment. In such an embodiment, a vertical column 11 and an associated clamping mechanism as shown in FIG. 2 may be disposed above the base 94. Thus, specially designed clamping pads may cooperate with specially designed base and frame members to clamp various types of containers. It is further possible to simply use one arm and clamping pad rather than a dual arm embodiment as disclosed.

As is apparent, various modifications and adaptations of the preferred embodiment will be apparent to those skilled in the art without departing from the scope and spirit of the invention. Therefore it is to be understood that, within the scope of the appended claims, the invention may be practiced other than as specifically described herein.

What is claimed is:

1. A security device for securing a stack of product or packing device articles comprising:

a vertical column member having a lower end;

sleeve means slidably mounted with respect to said vertical column member;

an arm means connected to said sleeve means;

a clamping pad connected to said arm means;

means for pivoting said arm means with respect to said sleeve means;

a base means;

means for attaching said base means adjacent the lower end of said vertical column member beneath said clamping pad;

means for moving said clamping pad up and down on said vertical column member and for locking said clamping means in position against a stack of said articles to retain said articles in a secure and locked position between said base means and said clamping means; and means for pivoting said clamping pad with respect to said arm means.

2. The security device of claim 1 wherein said clamping pad is of a generally "H" - shaped construction.

3. The security device of claim 1 wherein said means for moving further includes:

a chain connected to said sleeve means;

sprocket means for mounting said chain means to ride in said vertical column;

drive means for driving said sprocket means.

4. The security device of claim 3 wherein said drive means includes:

a crank rod;

a removable crank handle;

means for preventing slipping of said crank handle; and means for locking said removable crank handle in position.

5. The security device of claim 1 wherein said clamping pad comprises a substantially rectangular cap means for partially fitting over and retaining milk crates.

6. The security device of claim 1 wherein said base means comprises a substantially flat plate.

7. A security device for securing, at a location, first and second stacks of stackable articles comprising:

frame structure means for at least partially surrounding said first and second stacks of said articles, part of said frame structure means being positioned for separating said first and second stacks;

a vertical column attached to the part of said frame structure means positioned for separating said first and second stacks and extending above said frame structure means;

a sleeve slidably mounted on said vertical column member;

a swivel pivotally mounted on said sleeve;

first and second tubular receivers rigidly fixed to said swivel on opposite sides thereof;

first and second arms inserted into a respective one of said first and second tubular receivers and extending on opposite sides of said vertical column and over the location of said first and second stacks, respectively;

first and second pads pivotally mounted to said first and second arms, respectively, each pad including a retaining frame; and means for driving said sleeve up and down on said vertical column and for locking said sleeve in position on said vertical column, thereby locking each said retaining frame in a retaining position for retaining a respective one of said first and second stacks.

8. A security device for securing, at a location first and second stacks of stackable articles comprising:

frame structure means for at least partially surrounding said first and second stacks of said articles, part of said frame structure means being positioned for separating said first and second stacks;

a vertical column attached to the part of said frame structure means positioned for separating said first and second stacks and extending above said frame structure means;

a sleeve slidably mounted on said vertical column member;

a swivel pivotally mounted on said sleeve;

first and second tubular receivers rigidly fixed to said swivel on opposite sides thereof;

first and second arms inserted into a respective one of said first and second tubular receivers and extending on opposite sides of said vertical column and over the location of said first and second stacks, respectively;

first and second pads pivotally mounted to said first and second arms, respectively, each pad including an "H"-shaped retaining frame;

first and second sprocket means mounted to an upper and lower position of said vertical column, respectively;

a chain mounted to revolve about said first and second sprocket means;

means for attaching said sleeve to said chain;

means for driving the second sprocket means for causing said sleeve to travel up and down on said vertical column, said drive means comprising:

a crank rod;

a removable crank handle;

means for preventing slipping of said crank handle, and means for locking said removable crank handle in position.

9. A security device for securing, at a location, first and second stacks of stackable articles comprising:

frame structure means for at least partially surrounding first and second stacks of said stackable articles, part of said frame structure means being positioned for separating said first and second stacks;

a vertical column attached to the part of said frame structure means positioned for separating said first and second stacks and extending above said frame structure means;

a sleeve slidably mounted on said vertical column member;

means for adjusting the security device to height differences between said first and second stacks including:

a swivel pivotally mounted on said sleeve, first and second arms attached to said swivel and extending on opposite sides of said vertical column and over the location of said first and second stacks, respectively, and first and second pads respectively pivotally mounted to said first and second arms, each pad comprising a retaining frame; and means for driving said sleeve up and down on said vertical colum and for locking said sleeve in position on said vertical column, thereby locking each said retaining frame in a retaining position for retaining a respective one of said first and second stacks of stackable articles.

* * * * *